US005634186A

United States Patent [19]

Villalobos-Garcia et al.

[11] Patent Number: 5,634,186

[45] Date of Patent: May 27, 1997

[54] IMAGE FORMING MACHINE HAVING A VERIFIABLY OPENABLE SUMP SHUTTER ASSEMBLY

[75] Inventors: Luis M. Villalobos-Garcia; Jorge N. Pliego-Escalona; Miguel A. Carmona-Parra; Martin E. Villafaña-Chiquito; Alejandro Parra-Sánchez, all of Aguascalientes, Mexico

[73] Assignee: Xerox Corporation, Stamford, Conn.

[21] Appl. No.: 656,493

[22] Filed: May 31, 1996

[51] Int. Cl.[6] ..... G03G 15/03

[52] U.S. Cl. ..... 399/360; 399/120

[58] Field of Search ..... 355/298; 399/358, 399/360, 120

[56] References Cited

U.S. PATENT DOCUMENTS

| | | | |
|---|---|---|---|
| 4,849,791 | 7/1989 | Hagihara et al. | 355/298 |
| 5,398,098 | 3/1995 | Fukunaga et al. | 355/200 |

*Primary Examiner*—Joan H. Pendegrass
*Assistant Examiner*—Quana Grainger
*Attorney, Agent, or Firm*—Tallam I. Nguti

[57] ABSTRACT

A residual toner collecting system is provided in an electrostatographic reproduction machine. The collecting system includes units within the reproduction machine for generating waste or residual toner; members within the machine defining an elongate loading aperture for a removable cartridge, and a fixed position interference member adjacent the loading aperture. The collecting system also includes an elongate cartridge unit for removably loading into the loading aperture, and a residual toner collecting sump assembly connected to an externally directed end of the cartridge unit for receiving residual toner from the residual toner generating units. The collecting sump assembly includes a frame defining a visible end cavity, and a top wall defining a chamber for holding residual toner. The collecting sump assembly also includes an opening into the chamber, and a shutter assembly pivotably mounted to the top wall over the opening. The shutter assembly includes a generally flat shutter plate that is directly engageable by the interference member upon loading of the cartridge unit into the loading aperture. The shutter plate is automatically movable pivotably from a closed non-visible position, into an open position in the visible end cavity so as to be open and verifiably visible.

10 Claims, 8 Drawing Sheets

IMAGE FORMING MACHINE HAVING A VERIFIABLY OPENABLE SUMP SHUTTER ASSEMBLY

BACKGROUND OF THE INVENTION

The present invention relates to electrostatographic reproduction machines that produce toner copies of original images, and more particularly to such a machine including a waste toner collecting sump having a verifiably openable shutter assembly for preventing undesirable waste toner spillage within the reproduction machine.

Electrostatographic reproductions such as printers and copiers that use toner for producing copies of original images are well known. For example, such a machine, a copier 10, as disclosed in U.S. Pat. No. 4,849,791, is illustrated as a vertical section in FIG. 1. As is well known, the copier 10 includes a movable image bearing member 12 that is, a photoreceptor having a photoconductive surface, and that is movable about a continuous path. About the path is mounted a series of operational process units. The process units include a charging unit 13 for uniformly charging the photoconductive surface of member 12; an exposure assembly, including a platen 21 for holding an image to be exposed, an exposure lamp 22, and a light transmitting unit 14, for imagewise exposing the charged surface to form a latent image; and a development unit 15 containing toner for developing or making visible the latent image. The process units also include an image transfer unit 16 for transferring a developed image from the surface of member 12 onto a copy sheet fed from a sheet supply 17. The copy sheet is separated from the surface of member 12 with the help of a charging device 18, and is transported through a fusing unit 19 where the toner image is fused, and then into an output tray 20.

After separation of the copy sheet and toner image by the charger unit 18, residual or waste toner remaining on the surface of member 12 is removed by a cleaning unit 27. Cleaning unit 27 includes a conveyor or transport device 28 for moving the waste toner to a collection device or sump, such as to the collection container of the prior art, or to the collecting sump of the present invention (to be described below).

The prior art waste toner collection container and its shutter assembly as disclosed in U.S. Pat. No. 4,849,791, are illustrated in FIGS. 2 and 3. FIG. 2 is a perspective illustration of a cartridge type development unit 15 with a removable conventional waste toner collection sump or container 30 that is attached at one end thereof. As a cartridge, the development unit 15 comes with a cover 32 which when removed upon installation, exposes and positions a toner carrying development roll 34 (FIG. 1) adjacent the photoconductive surface of member 12.

As illustrated, the conventional sump or container 30 includes an opening 36 into a waste toner containing chamber, and a channel-shape sliding shutter 40 that is movable back and forth in the direction of the arrow 42. Edges of flange portions of the channel shutter 40 frictionally ride on the surface of the walls of the sump 30, and the shutter 40 is assembled for such movement by means of an arm 44 connected at one end to a fulcrum pin 46 in a slot 48. At the other end, a two headed pin 50 is provided for movement through a slot 52 in the shutter 40 and a corresponding slot 54 in the body of the sump 30. A fixed path extendable and return linear spring 56 is connected to the shutter 40 and to a fixed location on the sump for allowing the shutter to move in a direction opposite to the spring when the pin 50 is contacted and caused to move through the slots 52 and 54. When properly loaded into a machine such as into the machine 10, the opening 36 will be positioned directly below a discharge end 29 of the waste toner conveyor 28 (FIG. 1).

It has been found that prior art conventional waste toner collection sumps, such as 30, with such a conventional shutter mechanism, suffer from a number of significant disadvantages. In particular, it has been found that the pins 50, which must be brought into contact forcibly with a fixed member within the machine by a cartridge loading force in order to cause them to slide through the slots 52, 54, frequently tend to, and do often break easily. When the pins 50 break as such there is nothing left to cause the shutter 40, (which normally closes the opening 36), to open. The opening 36 therefore remains closed.

More seriously, the shutter 40, even when moved into an open position along the direction of the arrow 42, is hidden from view within the machine and is not visible to an operator looking at the development cartridge 15 and sump 30 from their external end, that is, from a direction as shown by the arrow 58. Therefore, when a pin 50 breaks easily as above and the shutter 40 fails to open, it is not easy or possible, to easily and visually verify such a failure. The undesirable consequences can include the discharge of significant amounts of waste toner into the machine.

There is therefore a need to provide a reproduction machine including a waste toner collection sump assembly having a visually verifiably openable and closable shutter assembly. In addition, there is a need to provide such a reproduction machine wherein the shutter assembly of such a sump is relatively more robust, more easily operated, less costly, and wherein the entire collecting sump is reusable or recyclable, and hence more environmentally friendly.

SUMMARY OF THE INVENTION

In accordance to the present invention, a residual toner collecting system is provided in an electrostatographic reproduction machine. The collecting system includes units within the reproduction machine for generating waste or residual toner; members within the machine defining an elongate loading aperture for a removable cartridge, and a fixed position interference member adjacent the loading aperture. The collecting system also includes an elongate cartridge unit for removably loading into the loading aperture, and a residual toner collecting sump assembly connected to an externally directed end of the cartridge unit for receiving residual toner from the residual toner generating units. The collecting sump assembly includes a frame defining a visible end cavity, and a top wall defining a chamber for holding residual toner. The collecting sump assembly also includes an opening into the chamber, and a shutter assembly pivotably mounted to the top wall over the opening. The shutter assembly includes a generally flat shutter plate that is directly engageable by the interference member upon loading of the cartridge unit into the loading aperture. The shutter plate is automatically movable pivotably from a closed non-visible position, into an open position in the visible end cavity, so as to be open and verifiably visible.

BRIEF DESCRIPTION OF THE DRAWINGS

In the description of the background and the invention presented herein, reference is made to the drawings, in which.

DETAILED DESCRIPTION OF THE INVENTION

Figure 1:
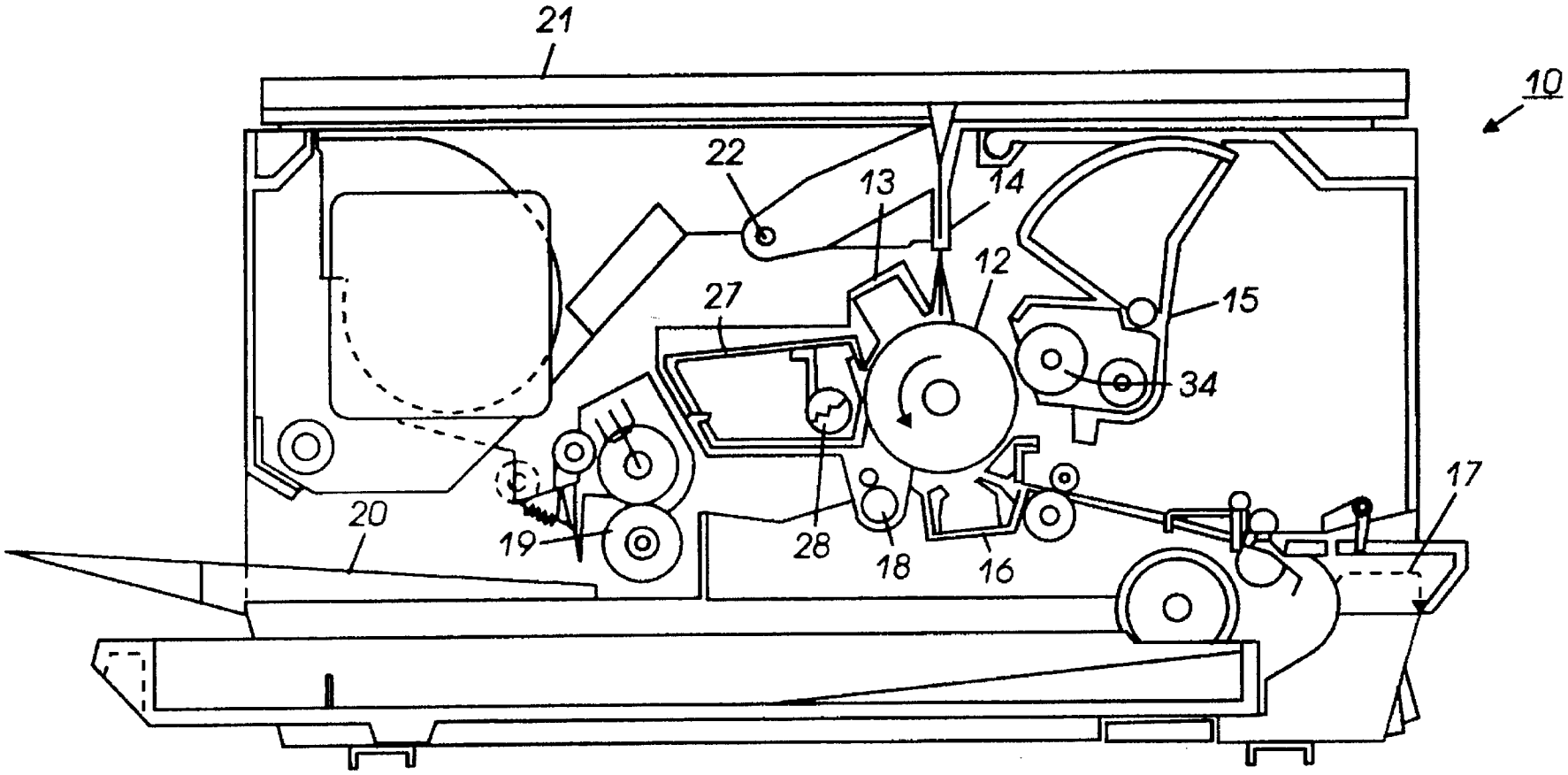
FIG. 1 is a schematic sectional side elevation of an exemplary electrostatographic reproduction such as that in accordance with the present invention.
Figure 2:
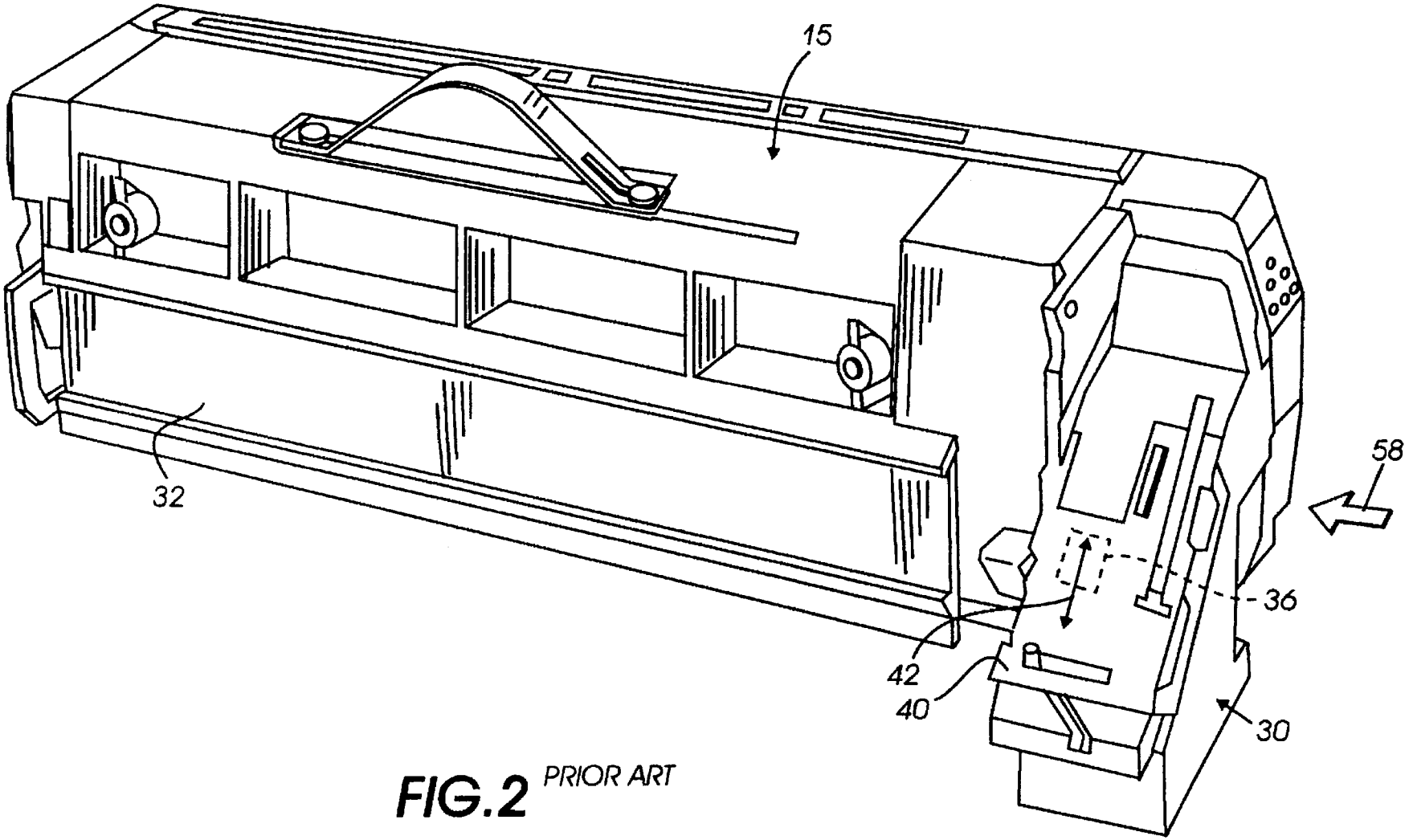
FIG. 2 PRIOR ART
FIG. 2 is a perspective view of a development cartridge including an attached conventional residual toner collecting sump.
Figure 3:
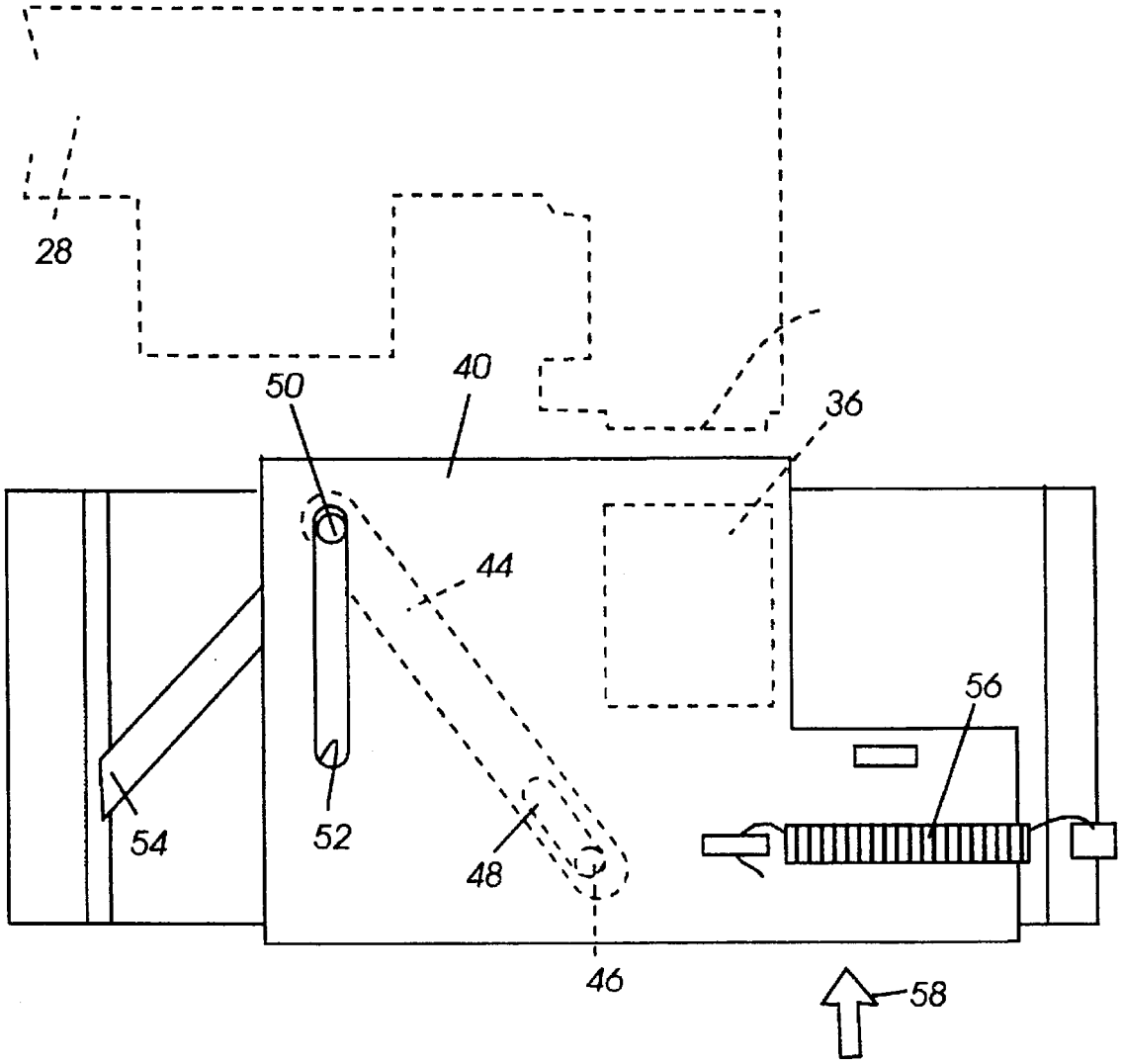
PRIOR ART FIG. 3
FIG. 3 is a schematic illustration of the structure and operation of a conventional shutter assembly to the collecting sump of FIG. 2.
Figure 4:
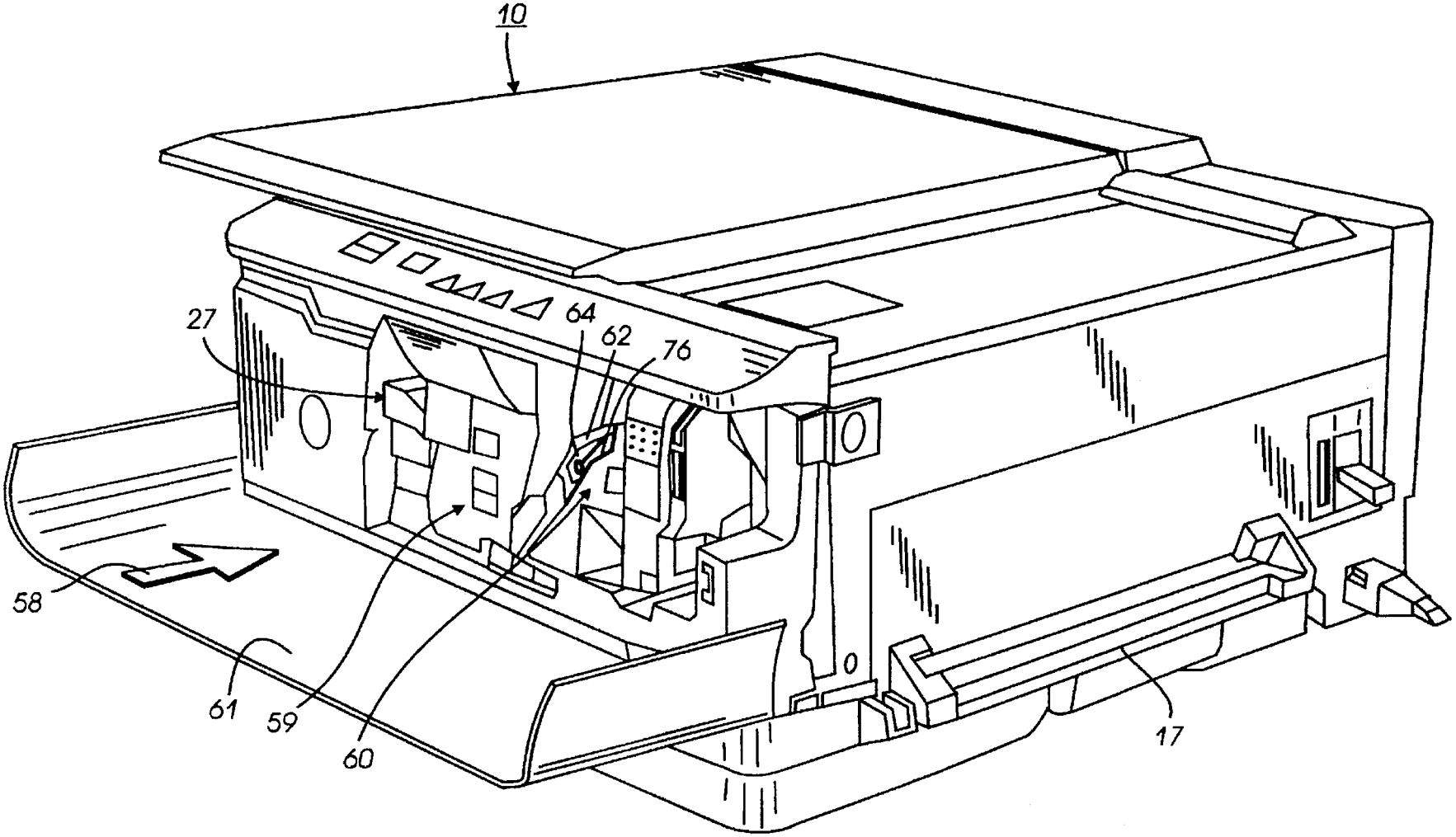
FIG. 4 is an open perspective view of the exemplary electrostatographic reproduction machine of FIG. 1, showing the externally positioned ends of a cartridge unit including the verifiably openable shutter assembly of the present invention.

Referring now to FIG. 4, an exemplary electrostatographic reproduction machine such as that of FIG. 1 is illustrated generally as 10. As is well known, and as described with reference to FIG. 1, the machine 10 includes a movable image bearing member 12 (FIG. 1) having an image forming surface; image forming means including a development unit 15 (FIG. 1) containing toner for developing an image formed on the image forming surface, and transfer means 18 (FIG. 1) for transferring a developed image from the image forming surface onto a copy sheet fed from a sheet supply 17 (FIG. 1). Additionally, the machine 10 includes a cleaning assembly 27, 28 (FIG. 1) for removing residual toner from the image forming surface after image transfer. In FIG. 4, as viewed externally from a direction indicated by the arrow 58, the image bearing member is located in the area 59. Importantly, in accordance to the present invention, the machine 10 includes a residual toner collecting sump assembly 60 that is visible as seen (arrow 58) from the end of the machine 10, when a service cover 61 is opened as shown.

Figure 5:
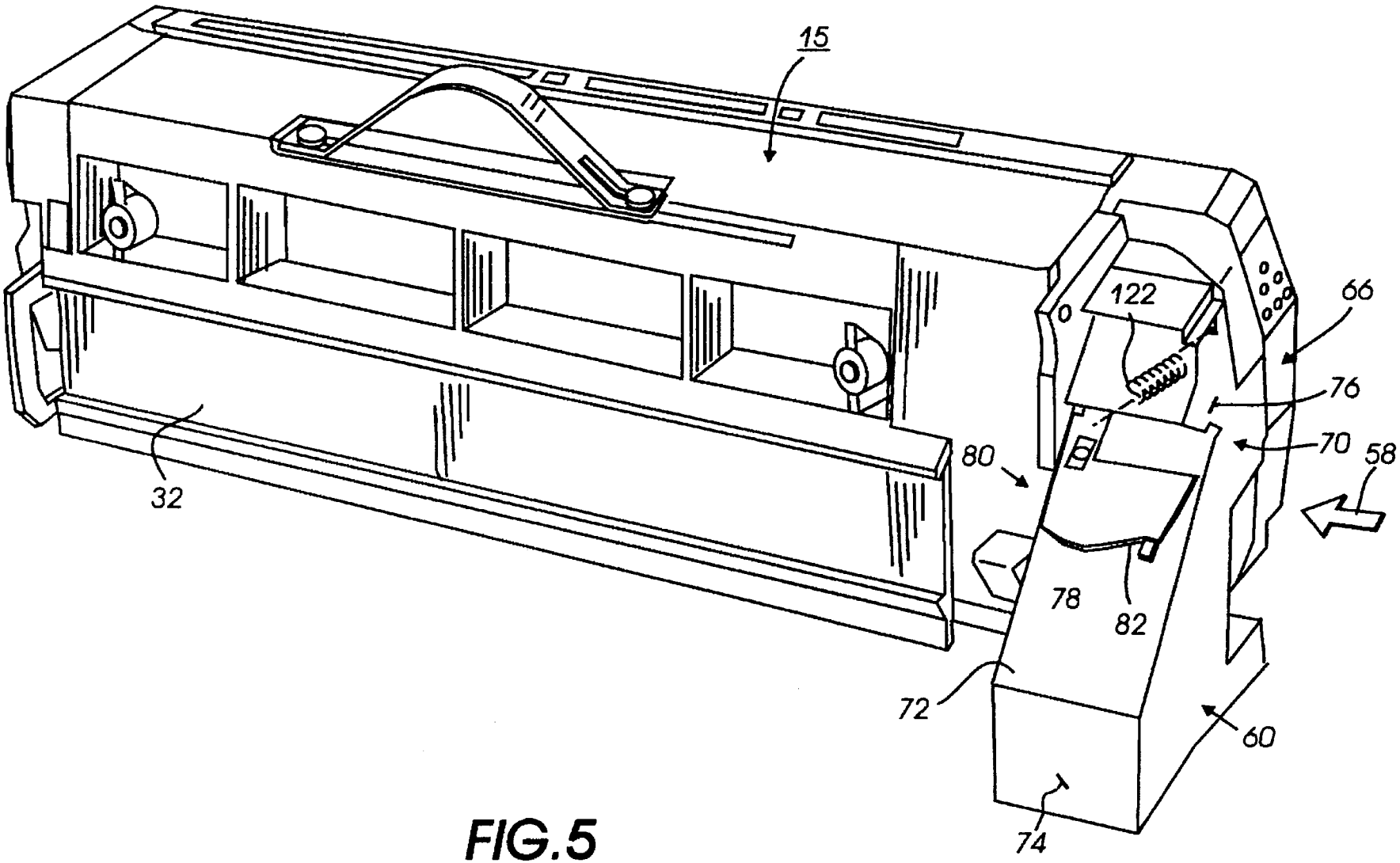
FIG. 5 is a perspective view of a development cartridge including the collecting sump of the present invention with the verifiably openable shutter assembly in a closed position.
Figure 6:
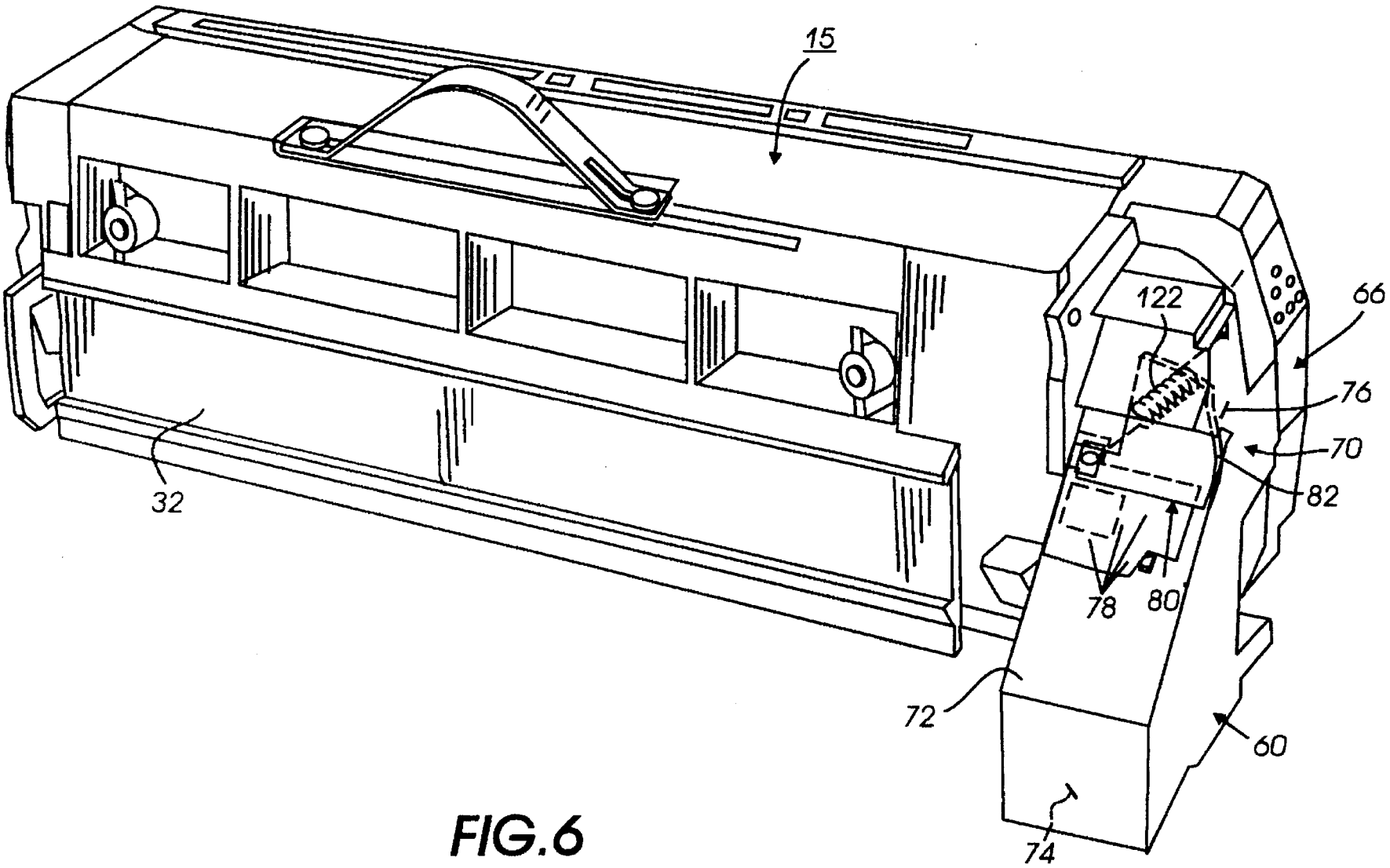
FIG. 6 is a perspective view of the development cartridge of FIG. 5, including the collecting sump of the present invention with the verifiably openable shutter assembly in an open and verifiably visible position.

Referring now to FIGS. 4 to 6, the residual toner collecting sump assembly 60 of the present invention is removably attached to a cartridge unit 15, so that it can be removably loaded into the machine 10 for receiving residual toner generated by a unit such as the cleaning assembly 27, 28 (FIG. 1). The development cartridge unit 15 comes with a cover 32 which when removed upon the installation of the cartridge into the machine, exposes and positions a toner carrying development roll 34 (FIG. 1) adjacent the photoconductive surface of the photoreceptor 12 (FIG. 1). The development cartridge unit 15 is loaded into the machine via an elongate loading aperture 62 defined by rigid members forming, for example, part of a frame for the image bearing member 12, in the area 59. Such rigid members include a fixed position interference member 64 located adjacent the loading aperture 62 for directly contacting and pivotably deflecting a shutter plate of the waste or residual toner collecting sump assembly of the present invention (to be described in detail below).

As clearly illustrated in FIGS. 5 and 6, a system for collecting residual toner in the machine 10 includes the residual toner collecting sump assembly 60 attached or connected to the externally directed end 66 of the cartridge unit 15 for receiving residual toner generated, for example, by cleaning unit 27, 28 (FIG. 1 ). The collecting sump assembly 60 includes a frame 70 and a top wall 72 which define a chamber 74 for holding residual toner. The frame, in addition, defines a visible end cavity 76 that can be seen by an operator from the direction 58 even after the cartridge unit 15 and sump assembly 60 are loaded into the machine 10. The top wall 72 includes a residual toner receiving opening 78 into the chamber 74.

As further illustrated in FIGS. 5 to 11, the residual toner collecting sump assembly 60 includes a shutter assembly 80 having a generally flat shutter plate 82. The shutter plate 82 is mounted pivotably to the top wall 72 and to the frame 70 for pivotal or rotational movement from a closed position (FIG. 5) over the opening 78, to a verifiably open and visible position within the end cavity 76 and away from the opening 78 (FIG. 6).

Figure 7:
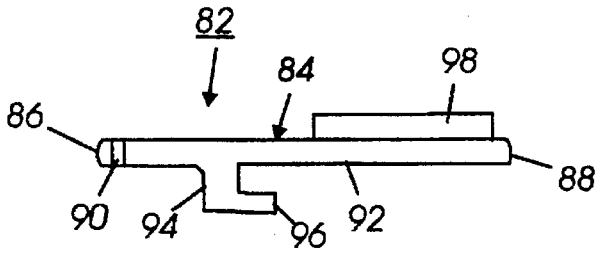
FIG. 7 is a vertical side schematic of the shutter plate of the present invention.

The generally flat shutter plate 82 is illustrated in detail in FIG. 7 and includes a main body portion 84 that is flat and shaped like a flag (FIGS. 5 and 6). The main body portion 84 has a first end 86 and a second end 88. The first end 86 includes an aperture 90 used for attaching a force applying spring. Importantly, the main body portion 84 includes a first, flat side or surface 92 for mounting against the top wall 72. The flat side 92 has a pin 94 and finger 96 member, formed integrally therewith towards the first end 86, and projecting therefrom, for mounting the plate 82 rotatably to the top wall 72. The inside edge of a second, top surface, opposite the surface 92, includes an engageable projecting flange 98 for interferably and directly coming into contact with the interference member 64, thereby causing the shutter plate to pivotably move from the closed position (FIG. 5) to the open position (FIG. 6).

Figure 8:
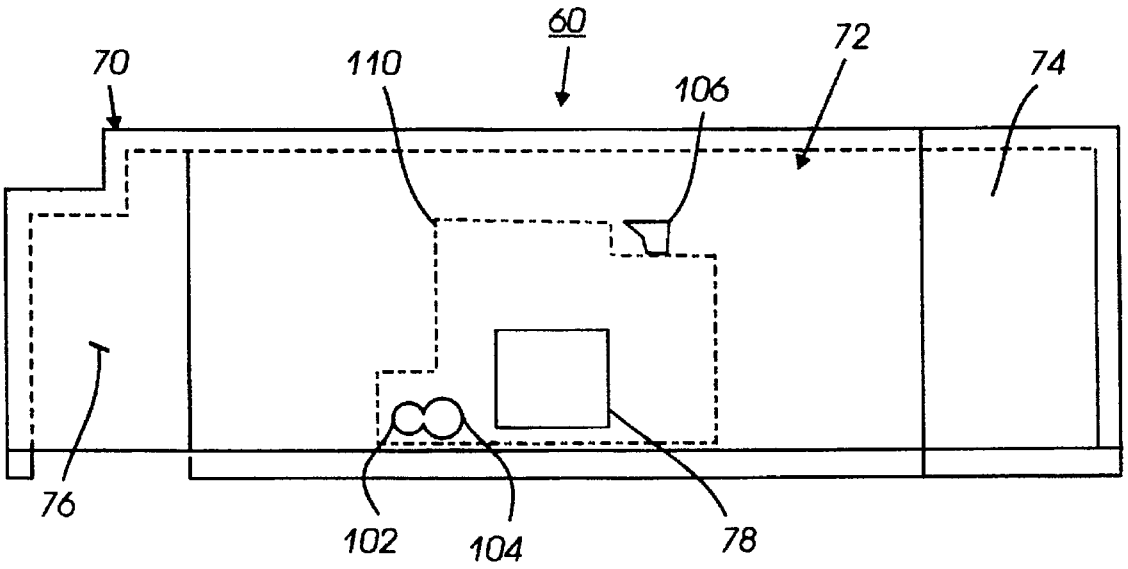
FIG. 8 is a top view illustration of the top wall of the collecting sump assembly of the present invention.
Figure 9:
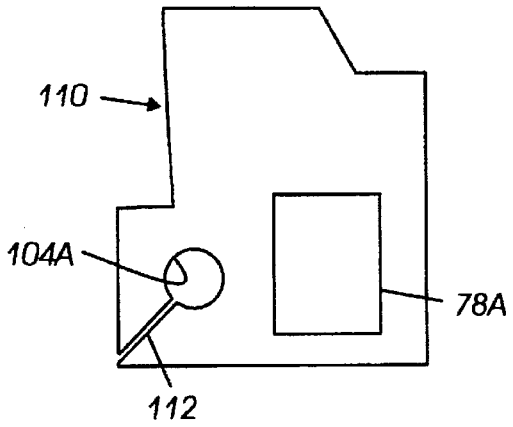
FIGS. 9 and 10 are top and side section illustrations respectively, of the seal member of the present invention.
Figure 10:
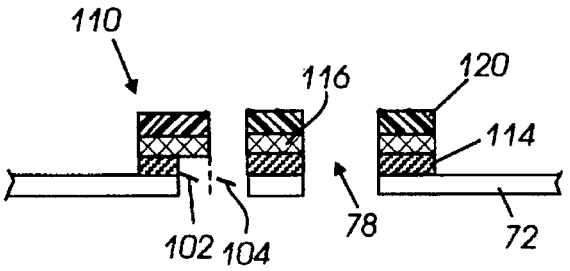
Figure 11:
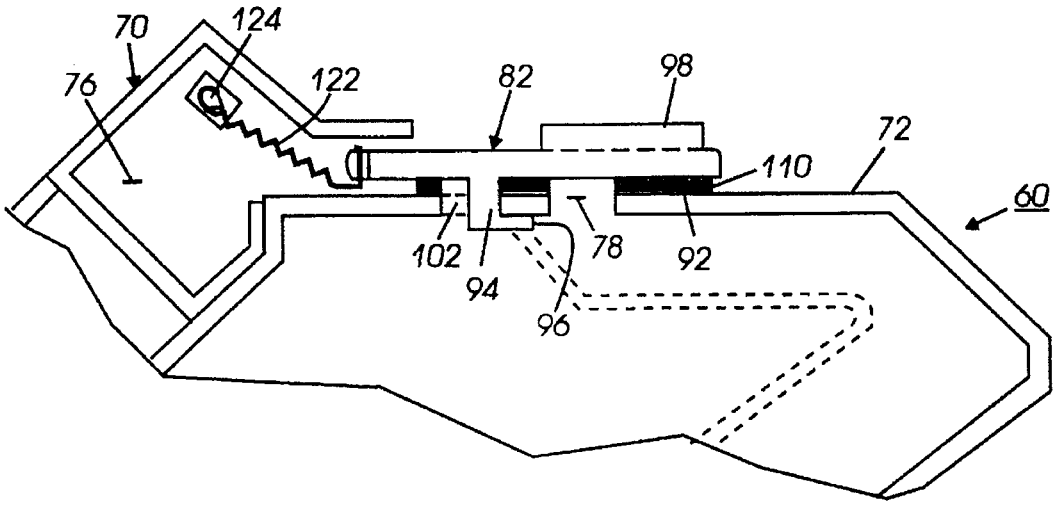
FIG. 11 is a cutaway schematic vertical section of the top wall and pivotably mounted shutter assembly of the present invention.

As shown in FIG. 8, the top wall 72 further includes overlapping openings 102, 104 for receiving the finger 96 and pin 94 member, respectively, when the shutter plate 82 is being mounted to the top wall 72. To insert the pin and finger member through the overlapping openings 102, 104, the shutter plate 82 is rotated about 180° from the direction illustrated, so as to align the horizontally projecting finger 96 with the opening 102, and the pin 94 simultaneously with the opening 104. The pin 94 is designed to fit closely but rotatably within the opening 104 so that waste toner within the chamber 74 cannot leak around it. After insertion, the shutter plate 82 is then again rotated and returned 180° to the orientation illustrated, thus moving the finger 96 from the insertion position aligned with the opening 102, into a non-aligned position within the chamber 74, thus securely retaining the shutter plate 82 to the top wall 72. The top wall 72 also includes a strategically formed stop member 106 for catching a step or notch portion on an edge of the shutter plate 82 located at the second end 88 thereof so as to properly position the shutter plate 82 in its closed position (FIG. 5).

Referring now to FIGS. 8 to 11, the residual toner collecting sump assembly also includes a seal member 110 that is mounted to the top wall 72, around the waste toner receiving opening 78, and under the shutter plate 82. The seal member 110 includes an opening 78A corresponding to the opening 78 in the top wall 72, as well as an opening 104A corresponding to opening 104 through which pin 94 fits. There is no corresponding opening to the finger opening 102 in the seal member 110, therefore that portion of the seal member over the opening 102 (after seal assembly), effectively closes and seals over the hole or opening 102. An assembly slit 112 is provided in this particular portion of the seal member as shown, so as to allow insertion of the finger 96 therethrough, after the seal 110 has been mounted to the top wall 72 as shown. The end 86 of the shutter plate 82, however, compressibly fits over the slit portion of the seal member, thereby preventing any possible toner spills through the slit 112.

The seal member 110 consists of an adhesive layer 114 for adhering to the surface of the top wall 72, a support layer 116 made of a suitable paper or fabric material, and a pile-height, compressible felt layer 120. The top surface of the horizontally extending finger 96 is spaced a predetermined distance from the flat side or surface 92 of plate 82, such that when the plate 82 is mounted over the seal member 110 and into the top wall 72, the side 92 partially compresses and seals slidably against the felt layer 120.

As described above, the means for pivotably mounting the shutter plate 82 to the top wall 72 and frame 70 include the overlapping openings 102, 104, and the pin 94 and finger 96. In addition, such means further include a force-applying spring 122 that is attached to the opening 90 at the first end 86 of the shutter plate 82, and to a retaining member 124 on the frame 70.

A desired distance between the retaining member 124 and the position of the opening 90 (when the shutter plate 82 is in the closed position) is importantly made slightly greater than the free-state length of the spring 122 so as to place the spring 122 in a first degree of tension when the shutter plate is in the closed position (FIG. 5). The force applying spring 122 thus lies along a first force-applying path when the shutter plate is in the closed position. However, when the second end 88 of the shutter plate 82 is moved pivotably (anti-clockwise as shown) into the second, open position (FIG. 6), the first end 86 with the spring 122 attached is also moved anti-clockwise about or around the pin 94. Such movement of the first end 86, thus moves the spring angularly from the first force-applying path, into a second and different force-applying path so as to be able to automatically cause the shutter plate 82 to pivot back from the open position into the closed position when the cartridge unit 15 is removed from the loading aperture 62 (FIG. 4). The force-applying spring 122 is moved into a second and greater degree of tension when lying along the second force-applying path.

In the residual toner collecting sump assembly 60, the frame 70 and walls (including 72) defining the chamber 74, are advantageously made of a tinted translucent and transparent plastic material, such as polycarbonate, for inhibiting undesirable visibility or show-through of scratches and wear and tear marks on the walls and frame, thus enabling environmentally friendly reuse and remanufacture of the collecting sump assembly. Prior art sumps are made, for example, of poly(methyl-methacrylate:styron) which has a transparent clear-like appearance, which after one use cycle, will not be found acceptable because obvious visible wear and tear marks, as well as because of an unacceptable contrast with toner color.

One sample of Poly(methyl-methacrylate:styron) (M1) material has been tested competitively against the polycarbonate material (M2) of the present invention, with the following results: Tensile strength @ break (psi) M1=9,000. M2=8,500; Elongation (%) M1=3–4. M2=2–3; Flexural strength (psi) M1=16,000. M2=12,000; and Izod Impact (if-lb/in) M1=0.3. M2=2.0. M2, the polycarbonate material of the present invention is clearly therefore a harder material, with less elongation. A sump made of M2 will therefore in addition have a longer life further enabling its recyclability and remanufacturing.

As can be seen, there has been provided a reproduction machine having a residual toner collecting sump assembly that overcomes the disadvantages of the prior art. The shutter assembly of the present invention is relatively more robust and reliable, and thus is not likely to fail and cause undesirable toner spillage within a machine. It's design and operation avoids movement friction problems from sliding, plastic to plastic surface contacts and possible inter-surface toner contamination. As such, it is also relatively less costly, having, of course, fewer parts. Importantly, the collecting sump assembly includes an open and verifiably visible shutter movement and position, so as to prevent machine operation with a failed, unopened shutter resulting in undesirable toner spillage into the machine.

While the embodiment disclosed herein is preferred, it will be appreciated from this teaching that various alternative, modifications, variations or improvements therein may be made by those skilled in the art, which are intended to be encompassed by the following claims:

What is claimed is:

1. An electrostatographic reproduction machine comprising:

(a) a movable image bearing member having an image forming surface;

(b) image forming means including a development unit containing toner for developing an image formed on said image forming surface;

(c) transfer means for transferring a developed image from said image forming surface onto a copy sheet;

(d) cleaning means for removing residual toner from said image forming surface; and (e) a residual toner collecting sump assembly removably loaded into the machine for receiving residual toner removed from said image forming surface, said residual toner collecting sump assembly including a frame defining an end visible cavity, a top wall defining a chamber for holding residual toner, a residual toner receiving opening through said top wall into said chamber, and a verifiably openable shutter assembly, said shutter assembly including a shutter plate being pivotably mounted on said top wall of said chamber in a closed position over said receiving opening, and being automatically movable pivotably from a non-visible closed position to an open and verifiably visible position within said end visible cavity when said residual toner collecting sump assembly is loaded into the reproduction machine.

2. The reproduction machine of claim 1, wherein said development unit is an elongate development cartridge removably loaded into the reproduction machine, and said residual toner collecting sump assembly is removably attached to an end of said elongate development cartridge.

3. The reproduction machine of claim 1, wherein said shutter assembly includes means for pivotably mounting said shutter plate to said top wall of said chamber, said mounting means including a pin and finger member projecting from a first end of said shutter plate, and a force applying tension spring attached to said first end of said shutter plate and to said frame for enabling automatic rotational return of said shutter plate from the open position to the closed position.

4. The reproduction machine of claim 3, wherein said shutter plate includes a first flat surface for mounting against said top wall, and a second and opposite surface having an engageable projecting flange for direct contact in moving said shutter plate from a closed position into the open and verifiably visible position.

5. A residual toner collecting system for an electrostatographic reproduction machine, the collecting system comprising:

(a) first means within the reproduction machine for generating residual toner;

(b) second means within the reproduction machine defining an elongate loading aperture for a removable cartridge, said second means including a fixed position interference member adjacent said cartridge loading aperture; and (c) an elongate cartridge unit for removably loading into said loading aperture, said elongate cartridge unit including a residual toner collecting sump assembly connected to an externally directed end of said elongate cartridge for receiving residual toner from said residual toner generating means, said collecting sump assembly including a frame defining an end visible cavity, a top wall defining a chamber for holding residual toner, and a residual toner receiving shutter plate directly engageable by said interference member upon loading of said cartridge unit into said loading aperture, said shutter plate being automatically movable pivotably from a closed non-visible position, into an open position within said visible end cavity, so as to be open and verifiably visible.

6. The residual toner collecting system of claim 5, wherein said top wall includes overlapping openings, and said shutter plate includes a projecting retaining and rotatable pin and finger member integrally formed at a first end of said shutter plate, for inserting through said overlapping openings, so as to retain and rotatably mount said shutter plate to said top wall.

7. The residual toner collecting system of claim 6, wherein said collecting sump assembly, including said frame and said top wall, are advantageously made of a tinted translucent plastic material for inhibiting visibility of scratches, and wear and tear marks, thus enabling environmentally friendly reuse and remanufacture of said collecting sump assembly.

8. The residual toner collecting system of claim 5, including a compressible seal member mounted around said opening and between said top wall and said rotatably retained shutter plate.

9. The residual toner collecting system of claim 5, wherein said shutter plate includes a first flat surface for mounting against said top wall, and a second and opposite surface having an engageable projecting flange for interferably contacting said interference member so as to cause said shutter plate to pivotably move from a closed position into an open and verifiable visible position within said visible end cavity.

10. The residual toner collecting system of claim 5, including a force-applying tension spring attached to said first end of said shutter plate and to a fixed position on said frame, said force-applying spring having a first force-applying path when said shutter plate is in a closed position, and a second and different force-applying path when said shutter plate is in the verifiably visible open position, so as to be able to automatically cause said shutter plate to pivot back into the closed position when said cartridge unit is removed from said loading aperture.

* * * * *